United States Patent [19]

Watson

[11] 4,200,024

[45] Apr. 29, 1980

[54] APPARATUS FOR MOUNTING A PERCUSSION INSTRUMENT

[76] Inventor: James B. Watson, 1440 Wilson St., Eugene, Oreg. 97402

[21] Appl. No.: 948,098

[22] Filed: Oct. 2, 1978

[51] Int. Cl.[2] ..... G10D 13/06; G10G 5/00

[52] U.S. Cl. ..... 84/421

[58] Field of Search ..... 84/421

[56] References Cited

U.S. PATENT DOCUMENTS 2,854,880 10/1958 Waters ..... 84/421

*Primary Examiner*—Lawrence R. Franklin

*Attorney, Agent, or Firm*—Kolisch, Hartwell, Dickinson & Stuart

[57] ABSTRACT

Apparatus for mounting a percussion instrument, such as a cymbal, includes a standard and rotatable means mounted on the standard for supporting the cymbal and permitting it to revolve, after impact, about an axis lying generally parallel to a plane defined by the marginal periphery of the cymbal.

5 Claims, 5 Drawing Figures

M
54
42
38
18
12

42
18
12

22
36
34
30a 44
50
52
40
42a
42
46
48

38
2
2
30a
16
22
20
30
42
3
3
40
26
12a
28
32
32a
24
18
12
14
14

APPARATUS FOR MOUNTING A PERCUSSION INSTRUMENT

BACKGROUND AND SUMMARY OF THE INVENTION

The present invention relates to percussion instruments, and more particularly to a novel apparatus for mounting a percussion instrument, such as a cymbal, so that it creates a unique musical sound as well as presents a vivid, intriguing appearance after impact.

Conventionally, cymbals are mounted on upright standards or posts so that the post extends through an aperture provided in the center of the cymbal. The cymbal may be secured to the post in a resilient manner so that upon impact, for instance by a drumstick or brush, the cymbal will produce a metallic ringing or crashing sound. Such sounds are dependent upon strength of impact, and type of device which effectuates the impact. Additionally, it is known to produce sounds with cymbals by contacting a pair of cymbals together. However, the types of sounds produced by cymbals in recording and live performances have changed little, from the standpoint of producing unique acoustical effects.

Accordingly, it is a general object of the present invention to provide a unique apparatus for mounting a percussion instrument, such as a cymbal, which includes a standard and a rotatable means mounted on the standard for supporting the cymbal and permitting it to revolve, after impact, about an axis lying generally parallel to a plane defined by the marginal periphery of the cymbal. As the cymbal revolves around the axis, an intriguing and musically unique phasing results, in that the pitch of the sound waves emanating from the cymbal go in and out of phase. The sound is somewhat similar to a ringing which oscillates between high and low pitch. Additionally, if the apparatus is used in a live performance setting, it creates a continuously flashing and pleasing appearance by virtue of the revolving cymbal.

Another object of the present invention is to provide an apparatus for mounting a cymbal in which the rotatable means includes an arm means having an elongate member with a central portion and opposed, off-set end portions rotatably mounted in a support means secured to the standard. Extending outwardly from the central portion is a post member on which the cymbal is mounted. Advantageously, the cymbal may be selectively positioned relative to the post member so that the center of gravity of the arm means combined with the cymbal and post member may be altered to predetermine the angle of repose (prior to impact) of the cymbal.

These and additional objects and advantages of the present invention will become more readily apparent from a consideration of the drawings and the following detailed description of the preferred embodiment.

DETAILED DESCRIPTION OF THE PREFERRED EMBODIMENT

Figures 1, 2, 3, 4, 5:
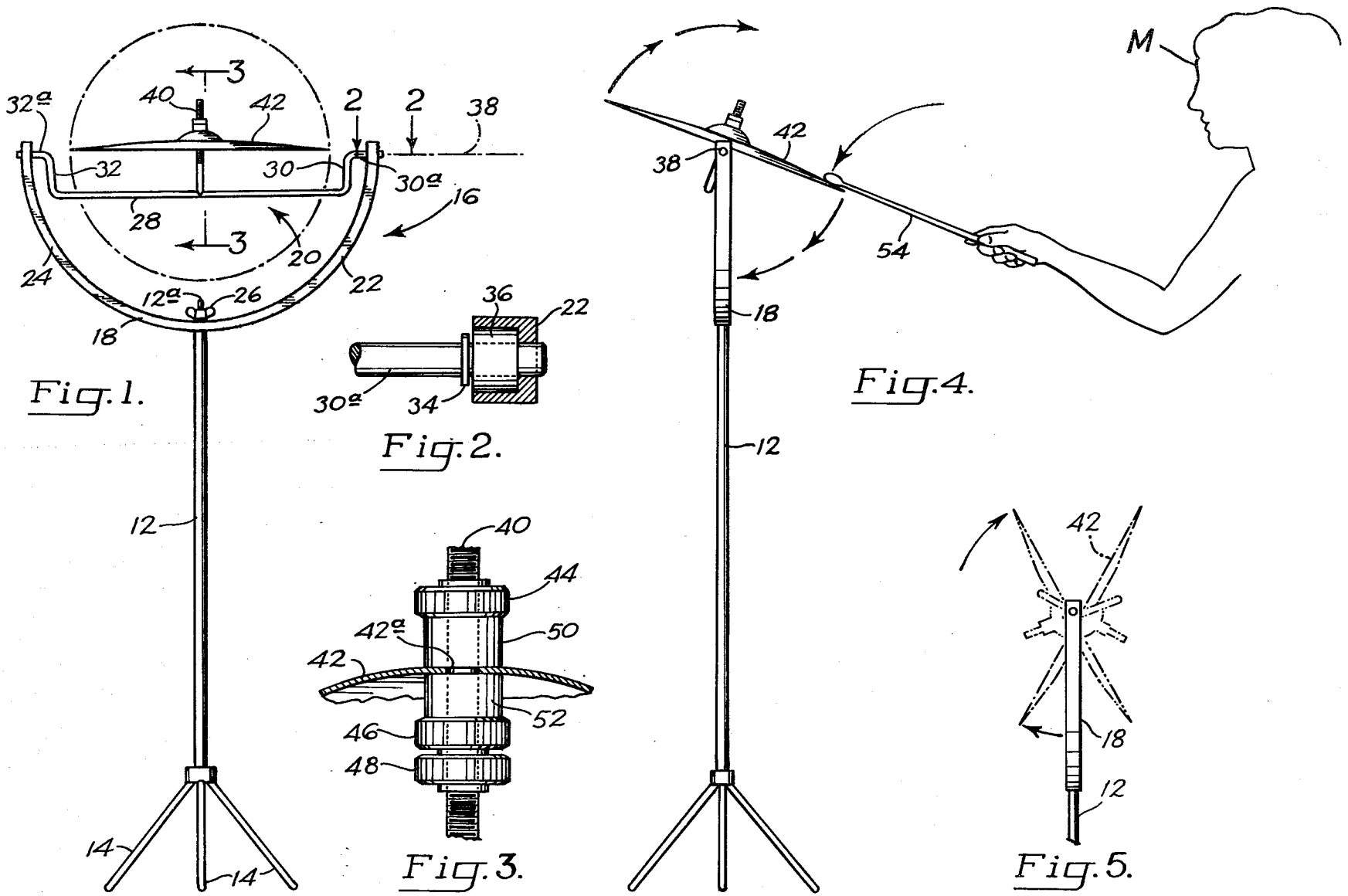
FIG. 1 is a front elevation view of an apparatus for mounting a percussion instrument, such as a cymbal, in accordance with the present invention.
FIG. 2 is an enlarged view taken along lines 2—2 and illustrates mounting of a rotatable arm means on a standard.
FIG. 3 is an enlarged view of a portion of the cymbal, illustrating its mounting on a post member secured to the rotatable arm means.
FIG. 4 is a side elevation view illustrating impact or striking of a cymbal mounted on the apparatus of the present invention so as to cause the cymbal to revolve, after impact, about an axis lying generally parallel to a plane defined by the marginal periphery of the cymbal.
FIG. 5 is a side elevation view illustrating continuous revolution of the cymbal after impact.

Turning now to the drawings, and referring initially to FIG. 1, apparatus for mounting a percussion instrument, such as a cymbal, is generally indicated at 10. More particularly, apparatus 10 includes a conventional upright standard 12 mounted on a floor surface by conventional adjustable legs 14. Mounted on top of standard 12 is a rotatable means generally indicated at 16 which includes a support means 18, of generally yoke-shaped configuration, and rotatable arm means generally indicated at 20. Support means 18 includes space-apart portions 22, 24 which provide a mounting for arm means 20. As can be seen, support means 18 is provided with an aperture (not shown) for receiving a threaded member **12*a* extending upwardly from standard 12 and is secured to the standard by means of a conventional locking device, such as a wing nut 26**.

Considering arm means 20, it can be seen that it includes an elongate member having a central portion 28 and opposed, off-set end portions 30, 32. Each of the end portions includes a segment, such as segments **30*a*, 32*a*, which are rotatably mounted or journaled within members 22, 24, respectively, of support means 18. As can be seen from a consideration of FIG. 2, segment 30*a* is mounted within member 22 and is retained by means of a suitable ring clip 34 or other equivalent locking device. Additionally, a suitable bearing, if desired, may be provided as indicated at 36. Thus, it can be appreciated that arm means 20 is rotatably mounted on support means 18 and is rotatable about an axis 38. It can also be seen that axis 38 is common to segments 30*a*, 32*a*, and is off-set from the longitudinal axis of central portion 28. Thus, axis 38 defines an axis of revolution about which central portion 28** may revolve in a manner to be hereinafter described.

With respect to central portion 28, there is provided a post means such as member 40 which extends outwardly therefrom and is threaded over a substantial portion of its length. Member 40 is suitably dimensioned for reception through a central aperture provided in a cymbal 42. As shown in FIG. 3, cymbal 42 includes an aperture **42*a* which receives member 40 and a suitable securing means such as curling nuts 44, 46 and locking curling nut 48 secure cymbal 42 to post 40 between a pair of resilient, felt washers 50, 52. As can be readily appreciated, cymbal 42 may be selectively positioned relative to the length of member 40 so that it may be secured at a desired predetermined position. Elaborating further, it can be seen that if cymbal 42 is positioned to a predetermined height along member 40, the center of gravity of the cymbal, arm means 20, and member 40 may be varied so that the cymbal will repose at an angle or tilt, relative to the horizontal, such as shown in FIG. 4. Oftentimes, it is preferable for a cymbal to repose at an angle or tilt to more readily accommodate striking action by a drummer. At any rate, the cymbal may be selectively positioned, relative to member 40**, so that horizontal positioning or any degree of tilt may be provided.

Turning now to a consideration of the advantageous use of apparatus 10 during a performance, attention is directed to FIG. 4 which illustrates a musician M initially impacting or striking a drumstick 54 against the outer or upper surface of cymbal 42. The result of the striking is to impart revolution to cymbal 42 and arm means 20 so that the cymbal revolves about axis 38. It can be seen that during revolution, cymbal 42 and central portion 28 revolve about axis 38 which lies generally parallel to and spaced from a plane defined by the marginal periphery of the cymbal. While the orientation of the plane may continuously vary, it can nonetheless be appreciated that axis 38 is always parallel thereto. Depending upon the force imparted by the musician, cymbal 42 and central portion 28 will continuously revolve about axis 38 for a given number of revolutions and create an intriguing and musically unique as well as pleasing sound.

More particularly, as cymbal 42 revolves about axis 38, it has been observed that the Doppler effect comes into play. Explaining further, during revolution of cymbal 42 and sound production therefrom, the cymbal can be considered as a moving source which moves toward and away from observers, such as an audience, thereby altering the pitch of the sound produced by the cymbal. The pitch and intensity will rise and fall proportional to the rate of revolution of the cymbal. For instance, as one edge of the cymbal moves away from an audience, the pitch will apparently drop, while the edge moving toward the audience will create a rise in pitch. Because the cymbal edges are not necessarily in phase, a totally different and heretofore uncreated sound results.

Furthermore, a revolving cymbal, as described above, presents an extraordinary form of entertainment to an audience, especially when suitable lighting is provided so that a flashing or stroboscopic effect is achieved. Thus, the apparatus of the present invention provides a revolving cymbal which creates both novel acoustical and observational effects.

Briefly considering materials contemplated for the construction of apparatus 10, it is noted that support means 18 may preferably be constructed of aluminum and arm means 20 of aluminum or steel. The important point to remember, as far as types of materials are concerned, is that lightness is of primary concern for the arm means.

While the invention has been particularly shown and described with reference to the foregoing preferred embodiment, it will be understood by those skilled in the art that other changes in form and detail may be made without departing from the spirit and scope of the invention as defined in the appended claims.

It is claimed and desired to secure by Letters Patent:

1. Apparatus for mounting a cymbal comprising:

a standard; and rotatable means mounted on said standard for supporting the cymbal and permitting it to revolve, after impact, about an axis lying generally parallel to a plane defined by the marginal periphery of the cymbal.

2. The apparatus of claim 1 wherein said rotatable means includes support means secured to said standard and arm means rotatably mounted on said support means, the cymbal being connected to said arm means.

3. The apparatus of claim 2 wherein said means includes an elongate member having a central portion and opposed, off-set end portions, and end portions being rotatably mounted on said support means about a common axis off-set from the longitudinal axis of said central portion which defines an axis of revolution about which said central portion may revolve.

4. The apparatus of claim 3 wherein said central portion includes post means extending outwardly therefrom for insertion through a central aperture in the cymbal, securing means being provided for securing the cymbal to said post means.

5. The apparatus of claim 3 wherein said support means includes spaced-apart members between which is rotatably mounted said arm means.

* * * * *